United States Patent [19]

McCaslin

[11] 4,224,762

[45] Sep. 30, 1980

[54] RADIO CONTROLLED TOY VEHICLE

[76] Inventor: Robert E. McCaslin, 1227 Coldwater Canyon, Beverly Hills, Calif. 90210

[21] Appl. No.: 902,458

[22] Filed: May 2, 1978

[51] Int. Cl.[3] ..... A63H 30/00

[52] U.S. Cl. ..... 46/256; 46/210; 46/254; 340/694

[58] Field of Search ..... 46/254, 256, 253, 210; 325/37; 343/225, 228; 244/190

[56] References Cited

U.S. PATENT DOCUMENTS

| | | | |
|---|---|---|---|
| 2,974,441 | 3/1961 | Denner | 46/256 |
| 3,764,984 | 10/1973 | McCartney | 343/225 X |
| 3,878,521 | 4/1975 | Licitis et al. | 46/254 X |
| 4,086,724 | 5/1978 | McCaslin | 46/256 |

FOREIGN PATENT DOCUMENTS

| | | | |
|---|---|---|---|
| 843802 | 8/1960 | United Kingdom | 46/256 |

*Primary Examiner*—Louis G. Mancene

*Assistant Examiner*—Mickey Yu

*Attorney, Agent, or Firm*—John L. McGannon

[57] ABSTRACT

A toy vehicle having a set of motor-driven drive wheels for moving it forwardly and a motor-driven steerable wheel assembly for effecting changes in the direction of movement of the vehicle. The vehicle has a radio receiver coupled to the drive motor of the steerable wheel assembly for energizing the drive-motor when signals are received by the receiver from a transmitter remote from the vehicle itself. In one embodiment, the steerable wheel assembly includes a single wheel rotatable about a vertical axis in one direction through an angle of 360°. In another embodiment, the steerable wheel assembly includes a pair of spaced wheels interconnected by a linkage shiftable back and forth in response to the rotation of a coupling member which rotates in one direction in a 360° arc. The transmitter has input means including a microphone and a Schmitt trigger unit or a one-shot multivibrator. The drive motor for the steerable wheel assembly can include a stepping motor.

4 Claims, 4 Drawing Figures

RADIO CONTROLLED TOY VEHICLE

This invention relates to improvement in motor-driven toy vehicles and, more particularly, to a toy vehicle which is controlled by a radio transmitter and receiver assembly.

BACKGROUND OF THE INVENTION

Motor-driven toy vehicles which can be steered have been known in the past. Typical of these toy vehicles are those disclosed in U.S. Pat. Nos. 2,974,441, 3,171,963; 3,406,481; 3,961,441; 3,142,132 and 3,458,950. For the most part, all of the toy vehicles of the foregoing disclosures are generally complex in construction unreliable in operation and expensive to produce. They, therefore, have drawbacks which limit their usefulness in providing interest and enjoyment to the users of such toy vehicles.

A device of the type disclosed in U.S. Application, Ser. No. 648,831 filed Jan. 16, 1976 provides a toy vehicle which carries a microphone coupled to a drive motor for the steerable wheel assembly thereof. Thus, voice commands sent directly to the microphone result in electronic signals which are used to energize the drive motor to effect changes in the direction of movement of the vehicle in response solely to the sounds picked up by the microphone. This vehicle, while satisfactory in certain applications, has limitations which prevent its being used when the sound from the speaker is blocked, such as by a wall or other barrier, or when extraneous, unwanted sounds are sensed by the microphone. Because of such limitations, a need has arisen for an improved type of vehicle, one controlled by a radio transmitter and receiver assembly to provide greater versatility for the user in controlling the vehicle.

SUMMARY OF THE INVENTION

The present invention satisfies the aforesaid need by providing an improved toy vehicle whose steering means is radio controlled so that changes in direction of the vehicle can be made without its being affected by sounds in and around the vehicle itself. To this end, the toy vehicle of this invention has a drive wheel assembly for moving it forwardly and a steerable wheel assembly for controlling the direction of movement thereof. The steerable wheel assembly has a drive motor coupled to the output of a radio receiver mounted on the vehicle, and the receiver has an input which receives radio signals emanating from a radio transmitter which can be hand-held at a location remote from the vehicle itself.

The transmitter, receiver and drive motor are arranged so that, for an input signal of a predetermined period applied to the input of the transmitter, there will be a predetermined angle of rotation of the steerable wheel assembly. In this way, greater control of the directional movement of the vehicle can be achieved yet the vehicle itself can be simple and rugged in construction and can be operated for the enjoyment by young and old alike without requiring special skills on the part of the user. If desired, the drive motor for the drive wheel assembly of the vehicle can be de-energized to stop the forward movement of the vehicle when signals are applied to the drive motor which controls the steerable wheel assembly.

The primary object of this invention is to provide an improved toy vehicle which is radio controlled, is simple and rugged in construction, is highly reliable, and can be operated without special mechanical or other skills.

Another object of this invention is to provide a toy vehicle of the type described wherein the vehicle has a steerable wheel assembly controlled by a drive motor which receives signals from a radio receiver carried by the vehicle, with the input of the receiver being operable to receive radio signals transmitted from a remote location, whereby, unique control of the forward movement and the steering of the vehicle can be achieved by controlling pulse widths of the signals transmitted to the receiver and the signals applied to the drive motor of the steerable wheel assembly.

Other objects of this invention will become apparent as the following specification progresses, reference being had to the accompanying drawings for several embodiments of the invention.

IN THE DRAWINGS

Figure 1:
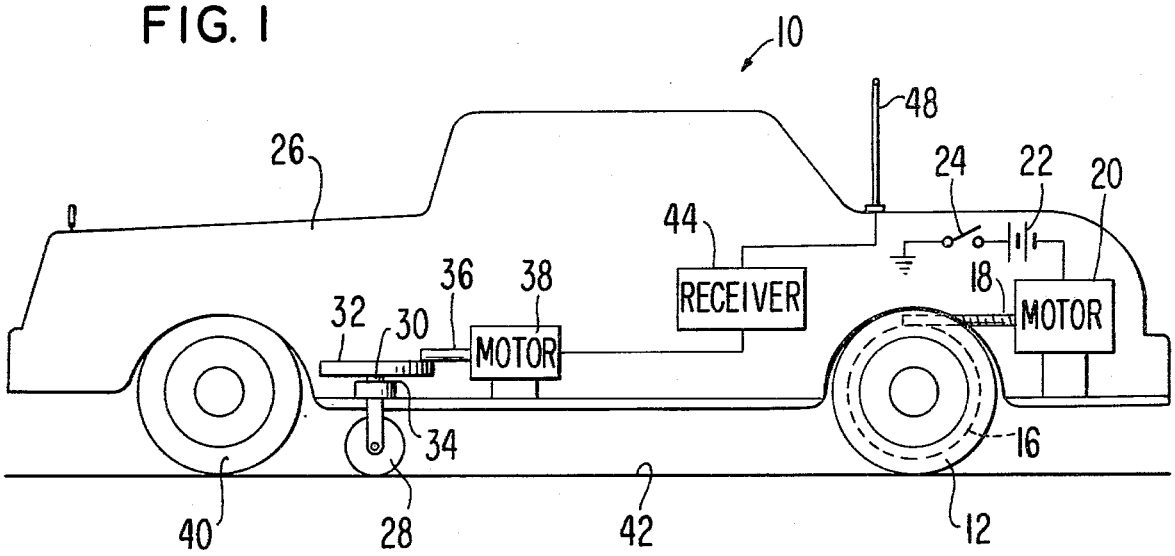
FIG. 1 is a schematic view of a toy vehicle using a radio transmitter and receiver for controlling the steering of the vehicle, showing one embodiment of a steerable wheel on the vehicle.

The toy vehicle of the present invention is broadly denoted by the numeral 10 and has means for driving it forwardly, such as a pair of rear wheels 12 having a shaft 14 provided with a worm gear 16 driven by a worm 18 on the drive shaft of a motor 20 operated by battery 22 in series relationship with an on-off switch 24. Battery 22 is carried in any suitable manner in the body or subject 26 of the vehicle.

In a first embodiment of the invention, vehicle 10 has a single steerable front wheel 28 mounted between the sides of body 26 on a shaft 30 having a disk 32 on the upper end thereof, there being a bearing 34 for mounting shaft 30 on body 26 for rotation in a 360° arc. Shaft 30 is rotated when the drive shaft 36 of a motor 38 carried by body 26 rotates in one direction as the motor is energized. Drive shaft 36 has its outer end in frictional engagement with the flat upper surface of disk 32 near the outer periphery thereof. Thus, when the motor is energized, drive shaft 36 rotates and in turn causes disk 32 to rotate. The motor could be coupled by other means, such as gear means, to shaft 30 instead of by disk 32 and shaft 36.

Vehicle 10 is shown with a front wheel assembly 40 forwardly of wheel 28. However, the wheels of the assembly 40 do not engage the surface 42 over which the vehicle moves; thus, the front wheel assembly 40 is merely for simulation purposes.

To energize motor 38, vehicle 10 is provided with a radio receiver 44 carried in body 26 and coupled by a lead 46 to an antenna 48 projecting outwardly from body 26 at any suitable location. Antenna 48 receives radio signals radiating from an antenna 50 (FIG. 3) of circuitry 49 including a tone transmitter 52 whose output is coupled to antenna 50. Circuitry 49 is preferably in a case which can be carried in the hand by a person located at a distance from the vehicle.

Figure 3:
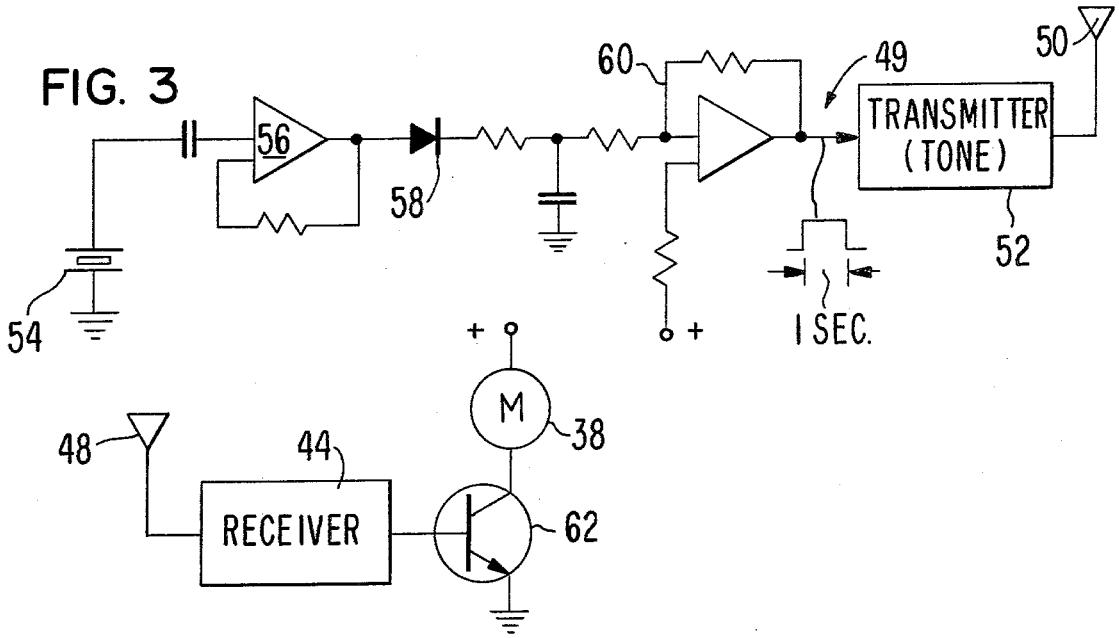
FIG. 3 is a schematic wiring diagram of the circuitry of the radio transmitter and receiver.

Circuitry 49 also includes a microphone 54, an amplifier 56, a rectifier 58 and a Schmitt trigger unit 60. In place of the Schmitt trigger unit, a one-shot multivibrator could be used. The microphone, amplifier, rectifier and Schmitt trigger unit are connected in a series relationship with tone transmitter 52 in the manner shown in FIG. 3. Also, the receiver is shown in FIG. 3 as provided with a transistor switch 62 at its output so that, when the receiver has a signal at its output, it will apply a voltage to the base of the transistor to cause it to switch to an on condition, thereby actuating drive motor 38 to rotate drive shaft 36. The Schmitt trigger unit is arranged so that, for an input signal to it which has a pulse width less than one second, there will be an output pulse from it whose pulse width is one second.

In operation, the person holding circuitry 49 will speak into the microphone and the electronic signal generated in the microphone will be amplified and rectified and will be directed to the Schmitt trigger unit, the output of the Schmitt trigger unit being operable to drive the tone transmitter which operates to emit a tone at a certain frequency, such as 27 mHz. The Schmitt trigger unit is adjusted so that any input to the microphone, such as saying the word "Right", produces a one second output from the Schmitt trigger, activating the tone transmitter for one second. This one second signal is transmitted by radiation from antenna 50 to antenna 48 where it is directed to receiver 44, is amplified and is used to actuate motor 38 for one second.

Figure 2:
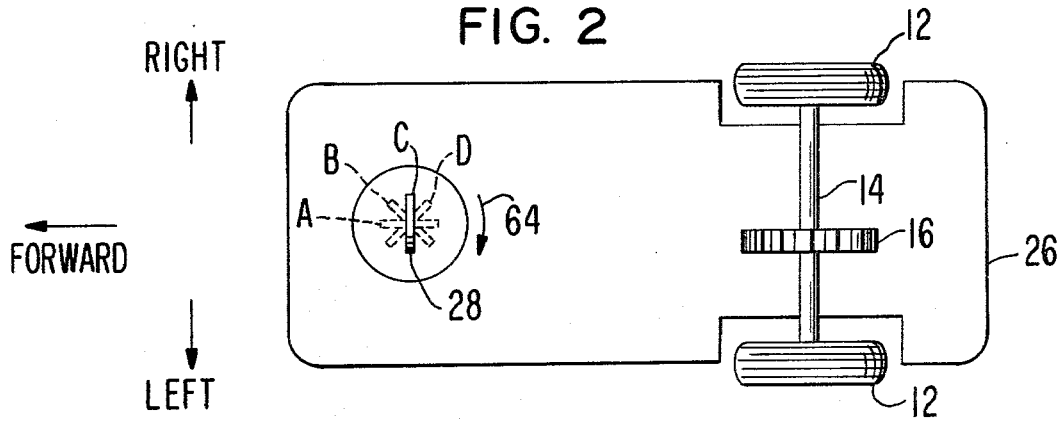
FIG. 2 is a bottom plan view of the vehicle of FIG. 1.

The coupling between the motor drive shaft and shaft 30 of the steerable wheel 28 is selected so that the one-second pulse applied to the motor turns wheel 28 through a predetermined angle, such as approximately 22.5°, in the direction of arrow 64 (FIG. 2). The next successive one-second pulse will move shaft 30 in the same direction another 22.5° and so on. Thus, if wheel 28 is in the A (straight ahead) position of FIG. 2, two one-second pulses received by motor 38 will cause wheel 28 to move from the A position to the B position (a right turn at 45° to the A position). The next two one-second pulses will move wheel 28 to the C position. At the C position, the vehicle will be stopped because the wheel is perpendicular to the forward direction of travel of the vehicle and the wheel will frictionally engage surface 42 sufficiently to impede forward movement of the vehicle even though motor 20 is still energized. By speaking additional one-second words into the microphone, wheel 28 can be made to move successively into a D position (a left turn) and into the A position once again. The angle through which wheel 28 is rotated is, therefore, controlled by words or sounds directed into the microphone.

Figure 4:
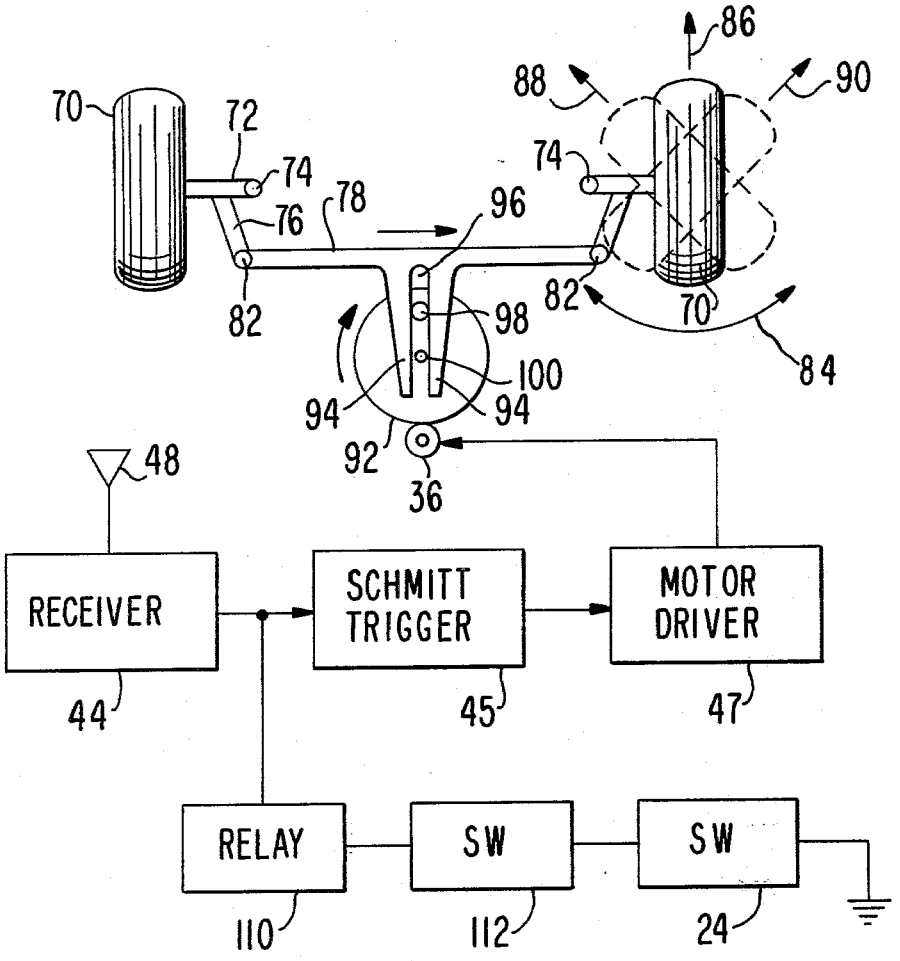
FIG. 4 is a top plan view of a second embodiment of the steerable wheel assembly for the vehicle of FIG. 1.

Another embodiment of the steerable wheel assembly of vehicle 10 can take the form shown in FIG. 4. In this embodiment the vehicle can have a pair of front wheels 70 mounted on axle 72 which are pivotally mounted by pins 74 on body 26. The axle 72 are pivotally coupled by arms 76 to respective ends of a push rod 78, the pivotal coupling being by pins 82. The wheels are capable of pivoting through a maximum angle of about 90° as shown by a curved arrow 84. The wheels can go forwardly as indicated by arrow 86, can go left as indicated by arrow 88, or can go right as indicated by arrow 90.

Push rod 78 is coupled to a rotatable disk member 92, such as by a pair of spaced legs 94 which define a slot 96 for receiving a pin 98 mounted on member 92 near the outer periphery thereof. Member 92 is rotated by a shaft 100 coupled in any suitable manner to body 12, and the drive shaft 36 of motor 38 is coupled in any suitable manner to member 92. For purpose of illustration, the coupling can be in the manner shown in FIG. 1 with member 92 being a disk and with shaft 36 frictionally engaging the disk. In another embodiment, member 92 can comprise a spur gear which meshes with a worm or another spur gear on shaft 36.

Member 92 rotates only in one direction, namely in the direction of arrow 102 and, in so doing, allows wheels 70 to move between the positions shown in dashed lines in FIG. 4.

In use, a one-second word transmitted from circuitry 49 is received by antenna 48 and directed to receiver 44 whose output can go to a switch, such as a Schmitt trigger unit 45 or a one-shot multivibrator, coupled to a motor driver 46 which is a circuitry for driving motor 38. Schmitt trigger unit 45 can be adjusted so that it gives, for instance, a one-second output for an input signal whose pulse width is one-second or less. Also, it can be adjusted to give any output signal of any duration, such as a two-second output if desired. Thus, a one-second word spoken into microphone 54 of circuitry 49 could provide an output signal from Schmitt trigger unit 45 of any duration, such as one-second, two-second, or other duration. Thus, the word "left" spoken into microphone 54 will be about one-second long and this one-second signal will be transmitted to receiver 44 which will apply an input signal to Schmitt trigger unit 45 whose output will depend upon how the Schmitt trigger circuitry is adjusted. Assuming a one-second duration output signal, this one-second signal will cause disk 92 to rotate in a clockwise sense in viewing FIG. 4 with the coupling between the drive shaft 36 and disk 92 being such that the one-second signal will cause a pivot of the wheels from the straight forward direction to the left turn direction indicated by arrow 88. The coupling between the shaft 36 and disk 92 could also be arranged so that for a one-second signal to the drive motor 38 would cause the wheels to rotate only 22.5° instead of 45°.

The above sequence can be broken at any time by giving commands of two words or more. For instance, if the vehicle were going left and a two-word command were spoken into the microphone, the wheels would move from the left direction to the right direction without stopping at the straight forward direciton.

It is possible to stop motor 20 when motor 38 receives a signal. This is accomplished by providing a relay 110 (FIG. 4) energized by the output signal from receiver 44, the relay having a normally closed switch 112 in series with switch 24 (FIG. 1). When a signal exists at the output of receiver 44, switch 112 is opened, thereby deenergizing motor 20. When the output signal is removed, motor 20 is again energized.

I claim:

1. A radio controlled toy vehicle comprising: a support having a first wheel assembly and a drive means coupled with the first wheel assembly for moving the support in a forward direction; a second wheel assembly rotatably mounted on the support for steering the support, said second wheel assembly including a single wheel having a shaft rotatably mounted on the support for rotation in one direction through an arc of 360°; a drive motor carried by the support and having a drive shaft, there being means interconnecting the motor drive shaft and the single wheel drive shaft for rotating the latter relative to the support in response to signals applied to the drive motor; a radio receiver carried by the support and having an antenna input for receiving a radio signal and an output including an electronic switch coupled to the drive motor; a transmitter remote from the support and having a microphone for receiving input signals and a Schmitt trigger unit coupled to the microphone, said unit being operable to provide and output signal of a predetermined pulse width for an input signal whose pulse width is equal to or less than said predetermined value, said transmitter having an output means for radiating output radio signals to the input of the receiver so that signals at the output of the receiver can be used to actuate the switch and thereby the drive motor, said transmitter, said receiver and said drive motor being operable to cause rotation of the single wheel through a predetermined angle for an input signal to the input means of the transmitter whose pulse width is equal to or less than a preselected value.

2. A radio controlled toy vehicle as set forth in claim 1, wherein said drive motor comprises a stepping motor.

3. A radio controlled toy vehicle comprising: a support having a first wheel assembly and a drive means coupled with the first wheel assembly for moving the support in a forward direction; a second wheel assembly rotatably mounted on the support for steering the support, said second wheel assembly including a single wheel having a shaft rotatably mounted on the support for rotation in one direction through an arc of 360°; a drive motor carried by the support and having a drive shaft, there being means interconnecting the motor drive shaft and the single wheel drive shaft for rotating the latter relative to the support in response to signals applied to the drive motor; a radio receiver carried by the support and having an antenna input for receiving a radio signal and an output including an electronic switch coupled to the drive motor; a transmitter remote from the support and having a microphone for receiving input signals, a one-shot multivibrator coupled to the microphone for generating output radio signals, and an output means for radiating output radio signals to the input of the receiver so that signals at the output of the receiver can be used to actuate the switch and thereby the drive motor, said transmitter, said receiver and said drive motor being operable to cause rotation of the single wheel through a predetermined angle for an input signal to the input means of the transmitter whose pulse width is equal to or less than a preselected value.

4. A radio controlled toy vehicle as set forth in claim 3, wherein said drive motor comprises a stepping motor.

* * * * *